US006065730A

United States Patent [19]

Marks et al.

[11] Patent Number: 6,065,730

[45] Date of Patent: May 23, 2000

[54] BOLT POSITIONING AND RETAINING DEVICE

[75] Inventors: Robin Marks, San Luis Obispo; Gregory S. Powell, Paso Robles, both of Calif.

[73] Assignee: Make-It Manufacturing, Inc., Pasco Robles, Calif.

[21] Appl. No.: 09/218,735

[22] Filed: Dec. 22, 1998

[51] Int. Cl.[7] ..... A47F 5/00

[52] U.S. Cl. ..... 248/314; 52/295; 249/219.1; 411/433

[58] Field of Search ..... 248/314, 300, 248/65; 52/702, 126.7, 699, 295; 249/219.1; 411/433, 437, 527

[56] References Cited

U.S. PATENT DOCUMENTS

| | | | |
|---|---|---|---|
| 1,954,928 | 4/1934 | Graef | 52/699 |
| 2,911,702 | 11/1959 | Clyncke | 52/699 |
| 3,150,429 | 9/1964 | Shaffer | 249/219.1 |
| 3,552,734 | 1/1971 | Severino | 52/699 |
| 4,412,407 | 11/1983 | Melfi et al. | 52/699 |
| 5,058,358 | 10/1991 | Stratton | 52/702 |
| 5,060,436 | 10/1991 | Delgado, Jr. | 52/295 |
| 5,337,534 | 8/1994 | Nasca | 52/295 |
| 5,670,076 | 9/1997 | Leek | 249/219.1 |
| 5,813,188 | 9/1998 | Behlen | 52/699 |

OTHER PUBLICATIONS

Printout of pages from web site of Holdem Company, Morro Bay, California, http://www.holdems.com.

*Primary Examiner*—Leslie A. Braun
*Assistant Examiner*—Kimberly Wood
*Attorney, Agent, or Firm*—Lyon & Lyon LLP

[57] ABSTRACT

A bolt positioning and retaining device possesses a base through which it is attached to a mud wall. The bolt positioning and retaining device also includes a stop, and may include one or more steps and corresponding step faces, each of which is capable of abutting an edge of a mud wall to enable accurate positioning of a bolt relative to that mud wall. The bolt positioning and retaining device also preferably includes a bolt retainer comprising a plurality of gripping flanges, which allow an anchor bolt to be quickly and easily inserted into the bolt retainer and which securely retain the bolt after insertion. The bolt retainer is located on an extension arm, which preferably extends outward from and at an angle to the plane of the base.

16 Claims, 6 Drawing Sheets

BOLT POSITIONING AND RETAINING DEVICE

BACKGROUND OF THE INVENTION

The field of this invention generally relates to construction, and more particularly to an apparatus for positioning and retaining a bolt while concrete or the like is poured around it.

Most buildings require a foundation. In many instances, this foundation is a concrete slab, created on the building site by pouring concrete into a wooden form, commonly referred to as a mud wall. In general, the mud wall is made of lumber, most commonly a 2×8 or stacked 2×8s.

It is generally advantageous to secure a building to its concrete slab foundation. By securing the structure to the slab, the structure is less likely to move off the foundation during a hurricane, tornado, earthquake, mudslide or other natural disaster. One way to secure a structure to a foundation is by using anchor bolts, so named because one end of an anchor bolt is anchored in the concrete foundation. This is typically accomplished by submerging one end of the anchor bolt in the wet concrete of the foundation as it is being poured and holding the anchor bolt in position until the concrete dries. The end of the anchor bolt protruding out of the foundation is typically threaded to receive a nut or other correspondingly-threaded object. The structure is typically anchored to the foundation by placing onto the anchor bolts a sill plate containing holes corresponding to the locations of the anchor bolts. Nuts or other fasteners are placed onto the portions of the anchor bolts protruding above the structural member and tightened. The sill plate is a member of a framed structure, which acts as the based upon which the frame is built. The sill plate is commonly a 2×4 or 2×6. Generally, the anchor bolts must protrude vertically or near-vertically to be of use in anchoring a structure, so that the sill plate can be placed onto them without interference and so that the nuts placed on the anchor bolts can exert a substantially downward force against the sill plate to hold it firmly against the slab.

Typically, the positioning of the anchor bolts relative to one another and relative to the edge of the concrete slab is important, and is generally set by the applicable building code. The position of the anchor bolts relative to one another is generally driven by the object or objects to be anchored. For example, if a frame wall is to be anchored to a concrete foundation, it typically contains several predrilled holes or apertures in its sill plate that correspond to the anchor bolts. Because the anchor bolts pass through those holes or apertures when that sill plate is placed onto them, the holes or apertures must match the relative positions of the anchor bolts. The position of the anchor bolts relative to the edge of the slab is driven by two primary factors. First, the anchor bolts cannot be too close to the edge of the foundation, or they may break through the resultant thin layer of concrete between them and the ground outside the foundation when subject to stress. Second, it is generally not desired for the anchor bolts to be too far from the edge of the foundation, or a portion of the foundation will be exposed after the structure is built on or placed on it.

Builders typically utilize some kind of apparatus to ensure that the anchor bolts are properly positioned in the concrete slab foundation. An apparatus in the prior art that has been used to position and hold anchor bolts while a concrete foundation is being poured is simply a wooden beam, such as a 2×4. Holes are drilled in the beam corresponding to the desired locations of the anchor bolts. A nut of larger diameter than the hole is screwed onto each anchor bolt, and each anchor bolt is then inserted into the beam so that it hangs through a hole, supported by contact between the nut and the upper surface of the beam. The beam is then placed across two mud walls such that the bottom portion of each anchor bolt protrudes into the space which the concrete will occupy after being poured. Using a beam to position and hold the anchor bolts has the advantages of accurately positioning the bolts relative to one another, and of securely holding the anchor bolts during foundation pouring.

The beam has several disadvantages. It is difficult to maintain a consistent distance from the edge of the mud wall to each bolt, because any misalignment of the beam affects all of the anchor bolts it holds. The beam requires significant labor to remove from the anchor bolts after the concrete has hardened. Each nut must be individually unscrewed from an anchor bolt, which can be difficult if wet concrete splashed onto and then dried on the threads. Further, use of the beam prevents masons from properly finishing out the surface of the concrete slab. As the concrete dries, masons typically finish it out with trowels and other tools in order to give it a smooth, flat surface. This is done to ensure that the structure sits flat on the slab. It also serves an aesthetic function, especially when the slab floor is not intended to be finished further, such as in a warehouse or industrial building. However, when the beam is used, masons can only trowel the slab up to the edge of the beam. If the concrete is poured slightly higher than the bottom of the beam, which is not uncommon, the beam will leave a rectangular depression in the finished slab that must be filled with additional concrete or with another material in order for the slab surface to be flat. Otherwise, a gap will exist between the slab and the wall or structure on top of it. Such a gap voids the thermal, moisture and pest barrier. Further, if the beam holding the anchor bolts is not parallel to the mud wall, the anchor bolts will not be parallel to the edge of the slab. As a result, walls of the structure that are attached to the anchor bolts may not meet at the intended angle. Finally, wet concrete can easily splash onto the threads of the anchor bolt during pouring. Typically, a portion of the threaded section of an anchor bolt sticks out above the beam, and is exposed to possible concrete splashes. After concrete splashes onto the threads and dries, it is difficult and time-consuming to remove. Removal of that dried concrete consumes valuable time, and can damage the threads of the anchor bolt.

Another apparatus that has been used to position and hold anchor bolts while a concrete foundation is being poured is a wire. Anchor bolts are secured to a wire, typically by wrapping the wire tightly around each anchor bolt. The anchor bolts are positioned relative to one another on the wire as they are desired to be positioned relative to one another when installed in the foundation. The wire is then strung between two supports such that the anchor bolts attached to it will be partly submerged into the concrete when poured. After the concrete has set, the wire must be unwrapped from the anchor bolt, and a mason trowels around and finishes out the concrete with the bolt in place. However, the wire provides minimal support for the anchor bolts. As the concrete is poured, the anchor bolts can easily deviate from a vertical position as the concrete moves and swirls, because the wire provides no lateral support. After the concrete dries, any anchor bolts which do not extend vertically have minimal utility at best; they may not fit through holes or apertures in the structure, and nuts or attachment devices screwed onto them will exert a noticeable lateral force as well as downward force, creating undesirable shear stress in the anchor bolts which can cause fatigue and eventual failure. The only solution is to break out the anchor bolt and re-pour that section of concrete. Re-poured sections are not as structurally sound, because the patched section does not substantially fuse with the hardened concrete around it. Unfortunately, some builders simply break out these bolts and do not replace them. Without the intended number of anchor bolts, the structure is not as securely attached to the foundation as it should be, and may not conform to the applicable building code.

Further, it is difficult to position the anchor bolts accurately when the anchor bolts are held by wrapping the wire around them. Precision winding is needed to ensure proper spacing between the bolts, precision which can be difficult to achieve at a busy work site. Further, as with the use of the wooden beam apparatus above, misalignment of the wire relative to the edge of the slab is possible, and has the same undesirable results. Finally, use of the wire provides almost no protection against wet concrete splashing on the threaded region of the anchor bolt, leading to the same undesirable consequences described with respect to the wooden beam apparatus.

Another device which has been used to position anchor bolts relative to a mud wall is a bolt holder. The bolt holder includes an open-ended guide tube for guiding an anchor bolt that protrudes vertically above a flat body. The flat body extends horizontally from the mud wall to which it is attached. An anchor bolt is inserted into the guide tube, and a nut or other fastener of greater diameter than the inner diameter of the guide tube is then attached to the threaded end of the anchor bolt. The nut thus rests on the top of the guide tube, suspending the anchor bolt therein. At the opposite end of the flat body member from the guide tube, a rear projection extends downward from the flat body member and abuts the rear surface of the mud wall.

Like the beam and the wire, the bolt holder possesses several disadvantages. As with the 2×4 apparatus, masons can only finish out the surface of the concrete slab up to the edge of the bolt holder. Further, the guide tube does not securely restrain an anchor bolt. The anchor bolt simply hangs by a nut from the hole in the end of the guide tube. If the concrete is poured slightly higher than the bottom of the bolt holder, which is not an uncommon occurrence, the apparatus will leave a rectangular depression in the finished slab that must be filled with additional concrete or with another material in order for the slab to be sufficiently flat. That depression is perpendicular to the sill plate, so if left unfilled, it will create a gap between the bottom member of a structure and the slab foundation which admits pests, moisture, and hot and cold air into the structure from outside. The bolt holder can adhere to the concrete slab if the slab is poured to a level above the lower surface of its body. In that situation, the apparatus generally must be removed from the dried slab with a degree of force that can damage or destroy it. Finally, the single projection possessed by the bolt holder limits it to accurate use with only one width of sill plate. If a sill plate of a different width is used, the anchor bolt may be placed too close to the edge of the slab or too far within it for proper use with that sill plate.

SUMMARY OF THE INVENTION

The present invention is directed to a structure for the positioning and retaining of an anchor bolt for the embedding of one end thereof. An extension arm extends outwardly from and at an angle to the plane of a base to a bolt retainer.

In a first, separate aspect of the invention, the extension arm extends outward and upward from the base. The bolt retainer at the opposite end of the extension arm may be positioned to hold an anchor bolt. Because the extension arm protrudes upward and outward from the base, the bolt retainer grips the anchor bolt above the surface level of the embedding surface.

In a second, separate aspect of the invention, one or more steps extend downward from the lower surface of the base of the bolt positioning and retaining device. A stop may be additionally included to extend downwardly from the base of the bolt positioning and retaining device at the opposite end of the base from the extension arm. A face of the step or the stop, where employed, may abut an edge of a mud wall when used in constructing a foundation, thereby allowing an anchor bolt to be positioned accurately relative to the mud wall. The presence of one or more steps along with the stop allows the bolt positioning and retaining device to be used to appropriately place anchor bolts for use with sill plates of different widths.

In a third, separate aspect of the invention, the bolt retainer possesses a plurality of thread grippers. The thread grippers preferably possess gripping flanges that are resilient and that exert an inward force on an anchor bolt inserted into the bolt retainer. The gripping flanges allow the removal of the bolt positioning and retaining device from the anchor bolt after one end of the anchor bolt has been embedded.

In a fourth, separate aspect of the invention, a lower tube extends below the bolt retainer and substantially prevents embedding material from splashing onto the threaded area of a bolt.

In a fifth, separate aspect of the invention, combinations of the foregoing aspects are contemplated.

Accordingly, it an object of the present invention to provide an improved bolt positioning device. Other and further objects and advantages will appear hereinafter.

DETAILED DESCRIPTION OF THE PREFERRED EMBODIMENTS

Figure 1:
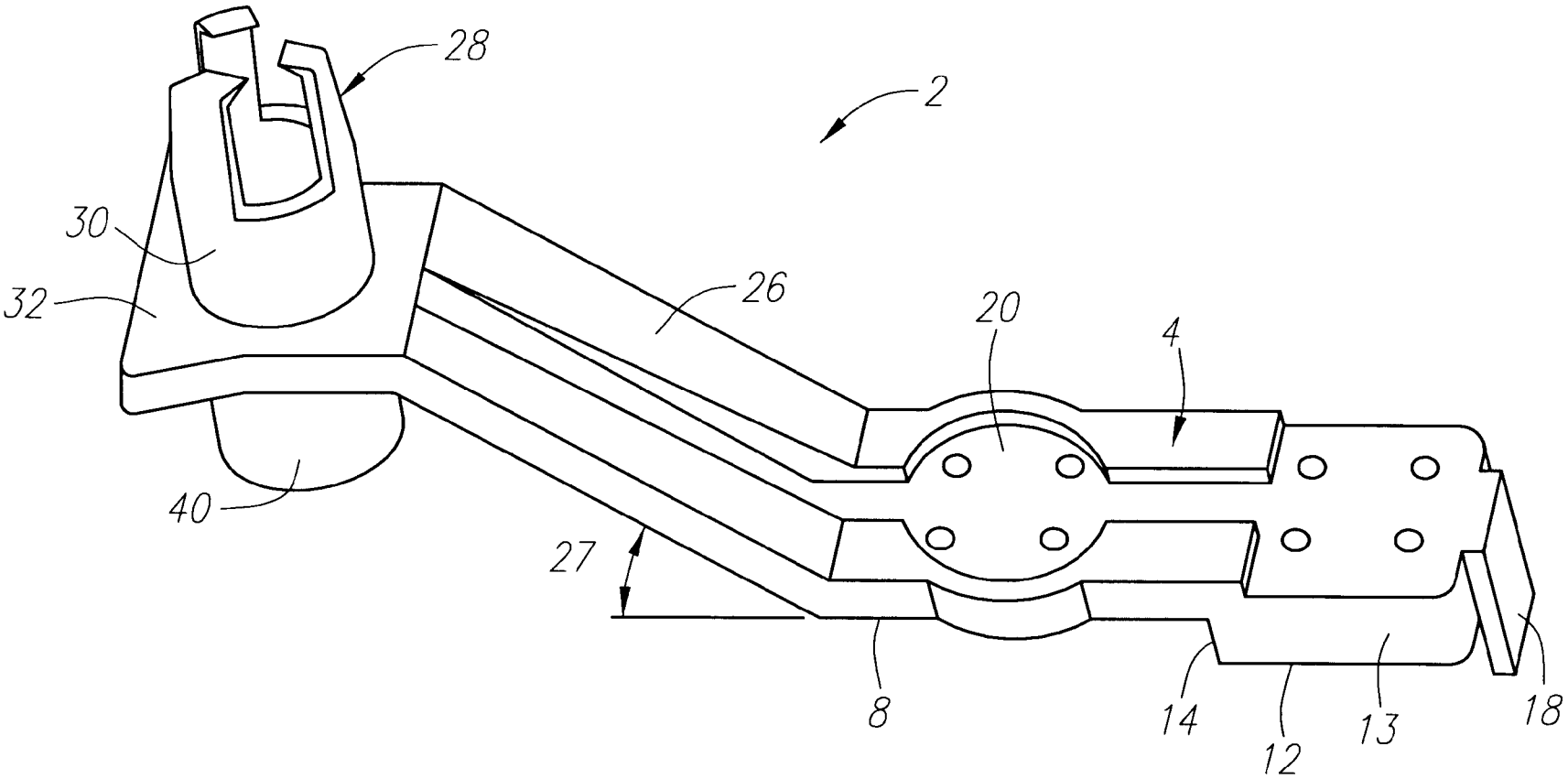
FIG. 1 is a perspective view of a bolt positioning and retaining device.

Referring to FIG. 1, a perspective view of a bolt positioning and retaining device 2 is shown. In a preferred embodiment, the bolt positioning and retaining device 2 is made of a material which possesses enough durability and deformability to withstand hammer blows during repeated installations. The bolt positioning and retaining device 2 is preferably constructed of plastic. However, other materials of suitable durability, including but not limited to metal or wood, may be used. Preferably, the bolt positioning and retaining device 2 is a unitary object. However, the bolt positioning and retaining device 2 may be constructed from multiple subassemblies or pieces of material if desired.

Figure 2:
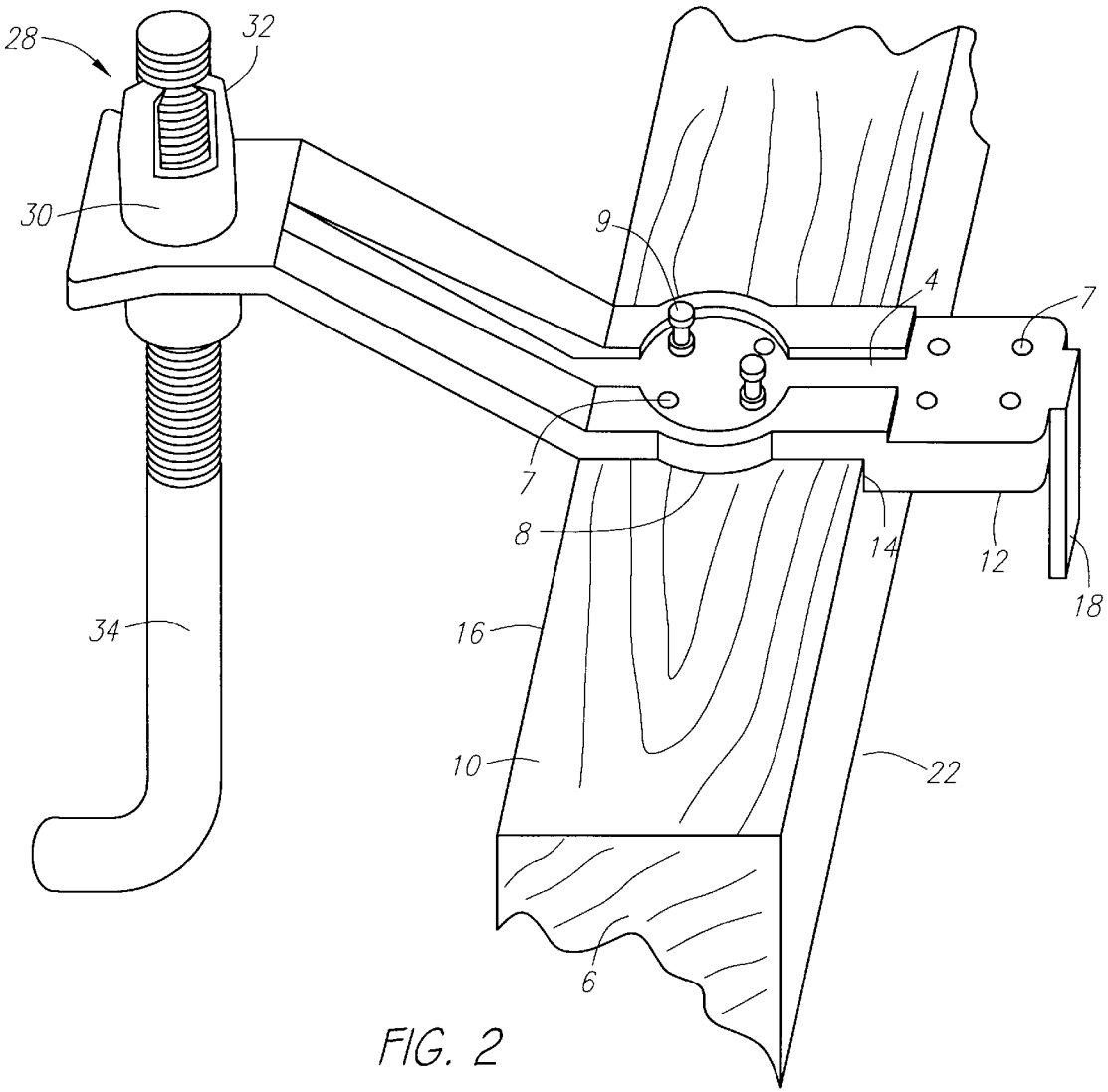
FIG. 2 is a perspective view of a bolt positioning and retaining device installed on a mud wall in a position to place an anchor bolt to accommodate a relatively narrow sill plate.

Referring to FIG. 2, the bolt positioning and retaining device 2 possesses a base 4 through which the bolt positioning and retaining device 2 may be attached to a mud wall 6. The base 4 is the portion of the bolt positioning and retaining device 2 that, when installed, is positioned against an upper surface 10 of the mud wall 6. In a preferred embodiment, the base 4 includes one or more apertures 7 extending substantially vertically therethrough. In the installed position, one or more fasteners 9, such as nails, may be inserted through the apertures 7 and into the mud wall 6, thereby holding the bolt positioning and retaining device 2 in place. The apertures 7 promote reusability and installation speed of the bolt positioning and retaining device 2, because the fasteners 9 need not be driven through the material comprising the base 4 in order to attach the base 4 to the mud wall 6. Preferably, a plurality of apertures 7 and fasteners 9 are used in order to provide greater stability.

Referring back to FIG. 1, in a preferred embodiment the underside of the base 4 includes one or more downwardly-extending steps 13. Each step 13 preferably possesses a substantially vertical step face 14. Referring to FIG. 2, the step or steps 13 preferably allow the bolt positioning and retaining device 2 to be attached to a mud wall 6 to accurately place bolts for use with a plurality of sizes of sill plates, thereby ensuring proper bolt spacing from the edge of the foundation for each such size of sill plate. In the construction industry at present, two sizes of sill plate are generally used: a 2×4 beam and a 2×6 beam. However, the present invention can suitably place anchor bolts for use with other sizes of sill plate.

The bolt positioning and retaining device 2 is shown attached to a mud wall 6, such as, for example, a 2×4 beam. Preferably, a step face 14 is positioned against a rear surface 22 of the mud wall 6. The step face 14 possesses a substantially planar surface that is substantially perpendicular to the plane of the base 4. As a result, a bottom surface 8 of the base 4 contacts the upper surface 10 of the mud wall 6. One or more fasteners 9 are inserted through one or more of the apertures 9 to secure the base 4 to the mud wall 6. The step face 14 is located a fixed distance from a bolt retainer 28. When the step face 14 is placed against the rear surface 22 of the mud wall 6, the bolt retainer 28 positions the anchor bolt a corresponding distance from the rear surface 22 of the mud wall 6. Because the width of the mud wall 6 is known, the distance between a front surface 16 of the mud wall 6 and the bolt retainer 28 is also known. In this way, the bolt positioning and retaining device 2 can consistently place an anchor bolt 34 at a desired distance from the front surface 16 of the mud wall 6. The front surface 16 of the mud wall 6 defines the edge of the foundation, so the anchor bolt 34 is thereby placed at a desired distance from the edge of the foundation. A sill plate of a corresponding width may then be placed over the anchor bolt 34 without protruding over the edge of the foundation or too far from the edge of the foundation.

Figure 3:
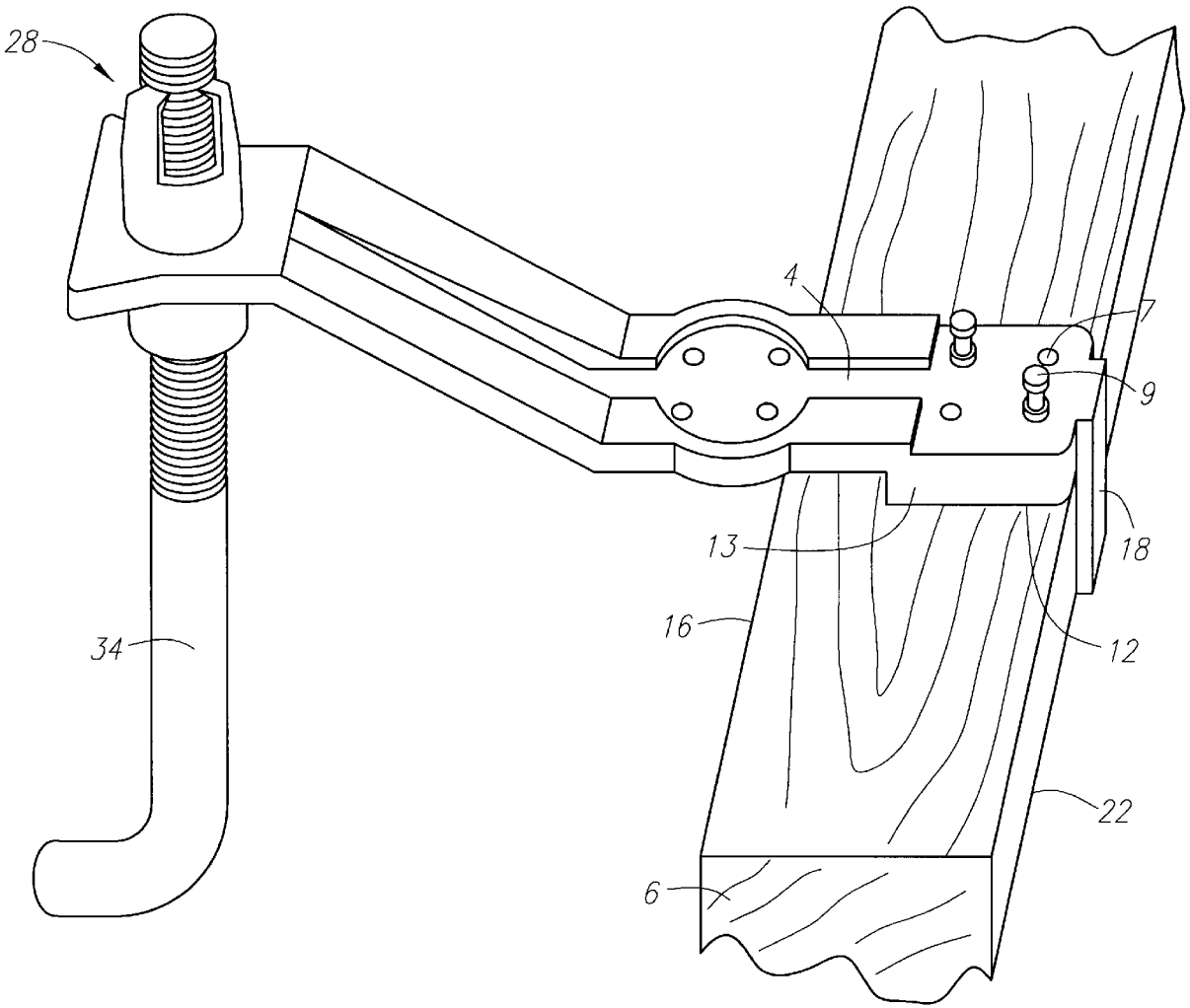
FIG. 3 is a perspective view of a bolt positioning and retaining device installed on a mud wall in a position to place an anchor bolt to accommodate a relatively wide sill plate.

Referring to FIG. 3, the base 4 also includes a stop 18. The stop 18 possesses a substantially planar surface that is substantially perpendicular to the plane of the base 4. As with the step face or faces 14, the stop 18 is positioned a known distance from the bolt retainer 28. When the stop 18 abuts the rear surface 22 of the mud wall 6, the bolt retainer 28 thus retains the anchor bolt 34 a corresponding distance from the front surface 16 of the mud wall 6. A bottom surface 12 of the step 13 rests on the upper surface 10 of the mud wall 6. The step 13 includes one or more apertures 7, through which one or more fasteners 9 are inserted to secure the base 4 to the mud wall 6. In a preferred embodiment, placing the stop 18 against the rear surface 22 positions the bolt retainer 28 further from the front surface 16 of the mud wall 6 than does placing the step face 14 against the rear surface 22. As a result, the anchor bolt 34 is positioned further from the edge of the foundation to be poured. Thus, the stop 18 is typically used when a wider sill plate, such as a 2×6, will be placed over the anchor bolts 34 after the foundation has dried. Locating the anchor bolts 34 further from the edge of the foundation allows a wider sill plate to be used without a portion of that wider sill plate protruding unsupported over the edge of the foundation.

In an alternative embodiment, the base 4 includes the stop 18. In this alternative embodiment, the bolt positioning and retaining device 2 is used with a mud wall 6 to hold the anchor bolt 34 in position to accept a single size of sill plate.

Referring back to FIG. 1, an extension arm 26 extends outward from the base 4. The extension arm 26 also extends at an angle to the plane of the base 4. With the base 4 properly positioned atop a mud wall 6, the extension arm 26 extends upwardly. Preferably, the extension arm 26 is formed integrally with the base 4, but the extension arm 26 and the base 4 may be composed of separate pieces that are joined together. The extension arm 26 is preferably connected to the bolt retainer 28 at or near the opposite end of the extension arm 26 from the end of the extension arm 26 that is connected to the base 4. Referring to FIG. 2, the extension arm 26 extends outward from the base 4 to position the bolt retainer 28 in front of the mud wall 6, such that the bolt retainer 28 is located above an area into which concrete will be poured, and located a substantially fixed distance from the front surface 22 of the mud wall 6. The extension arm 26 extends upward from the base 4 in order to position the bolt retainer 28 above the area into which concrete will be poured and above the surface level of the concrete. By gripping an anchor bolt 34 at a distance above the surface of the concrete, a mason can trowel around the anchor bolt 34 held in place by the bolt retainer 28.

Referring to FIG. 1, the extension arm 26 projects upward and outward from the base 4 at an angle 27. The angle 27 is chosen such that the bolt retainer 28 can hold the threaded portion of the anchor bolt 34 at a location such that bottom of the anchor bolt extends a sufficient distance into the slab foundation after pouring, no matter whether a step 13 or the stop 18 is placed against and fastened to the upper surface 10 of the mud wall 6. The angle 27 is also chosen to hold the anchor bolt 34 a correct distance above the concrete so that enough of the threaded area of the anchor bolt 34 is exposed above the concrete to allow for bolting down a sill plate. The angle 27 and the thickness of each step 13 are thus related to one another, and are chosen in conjunction with one another to ensure proper functioning of the bolt positioning and retaining device 2. In a preferred embodiment, the angle 27 measures substantially 39 degrees.

Referring back to FIG. 2, the steps 13 preferably increase in thickness in the direction away from the extension arm 26. Preferably, each step face 14 is oriented substantially toward the bolt retainer 28. The stop 18 is preferably located at the end of the base 4 furthest from the bolt retainer 28, and is thereby preferably adjacent to the thickest step 13. In an alternate embodiment, the steps 13 decrease in thickness in the direction away from the extension arm 26, and each step face 14 is correspondingly oriented substantially away from the bolt retainer 28. In this embodiment, the base 4 could be constructed such that one of the step faces 13 or the stop 18 abuts the front surface 16 of the mud wall 6, if desired.

The bolt retainer 28 preferably includes an upper tube 30 and thread grippers 32. The upper tube 30 extends upward from the extension arm 26. The upper tube 30 is a hollow structure, preferably substantially cylindrical, that enables an anchor bolt 34 to slide through it. The bolt retainer 28 is preferably designed to function in conjunction with an anchor bolt 34 of a certain diameter, such that the inner diameter of the upper tube 30 is only slightly larger than the outer diameter of the anchor bolt 34. The narrow clearance between the upper tube 30 and the anchor bolt 34 helps prevent concrete from splashing into the upper tube 30 and spattering the anchor bolt 34. By substantially preventing concrete from splashing onto the upper portion of the anchor bolt 34, the upper tube 30 reduces the time and expense required to clean the threads of the anchor bolt 34 after concrete has been poured.

Figure 4:
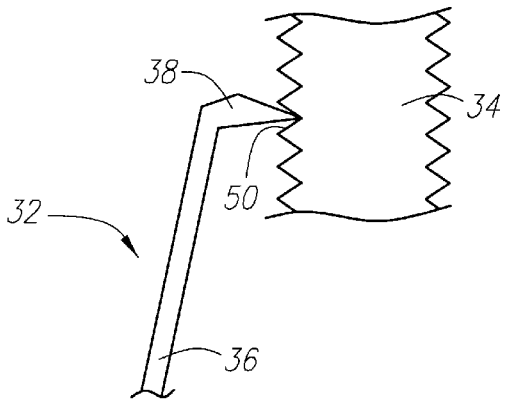
FIG. 4 is a detail view of a thread gripper holding a bolt.

In a preferred embodiment, one or more thread grippers 32 extend upward and inward from the upper tube 30. Preferably, three thread grippers 32 are used. However, more or fewer thread grippers 32 may be used as long as the number of thread grippers 32 chosen are capable as a group of securely holding the anchor bolt 34. Referring to FIG. 4, each thread gripper 32 includes a body section 36 and an inward-pointing head 38. Referring back to FIG. 2, the anchor bolt 34 is inserted into the bolt retainer 28 by pressing its threaded end into the bolt retainer 28. Each thread gripper 32 is constructed of a material flexible enough to deflect and allow for such insertion of an anchor bolt 34, but that moves back into place after such insertion, thereby exerting a force against the anchor bolt 34. In this way, the head 38 of each thread gripper 32 presses inward against the anchor bolt 34. Referring to FIG. 4, the tip of each head 38 is preferably narrow enough to fit substantially into a thread 50 of the anchor bolt 34. The tip of each head 38 thus works to support the anchor bolt 34 both by exerting an inward force on the thread 50, and by providing a support against gravity for the upper part of the thread 50. Each head 38 thereby supports the anchor bolt 34 against the downward pull of gravity. The force exerted against the anchor bolt 34 by the thread grippers 32, combined with the support provided by the tips 40 against the threads of the anchor bolt 34, holds the anchor bolt 34 in place. The narrowness of the upper tube 30 also aids in stabilizing the anchor bolt 34.

Referring back to FIG. 1, in a preferred embodiment, the extension arm 26 flares outward from the bolt retainer 28 to form a bolt retainer flange 32. Preferably, the bolt retainer flange 32 extends in a direction substantially perpendicular to the centerline of the bolt retainer 28. The bolt retainer flange 32 helps prevent concrete from splashing onto the upper threads of an anchor bolt 34 held by the bolt retainer 28.

In a preferred embodiment, a lower tube 40 extends underneath the bolt retainer 28. The lower tube 40 is hollow, thereby enabling the anchor bolt 34 held by the bolt retainer 28 to slide through it without impediment. Referring to FIG. 2, the lower tube 40 is preferably substantially cylindrical and substantially protects a portion of the anchor bolt 34 from concrete that would otherwise splash onto it during pouring. Splashing concrete spatters the lower tube 40 rather than the anchor bolt 34 it protects.

Several alternate embodiments of the bolt positioning and retaining device 2 that employ the principles disclosed above are also possible.

Figure 5:
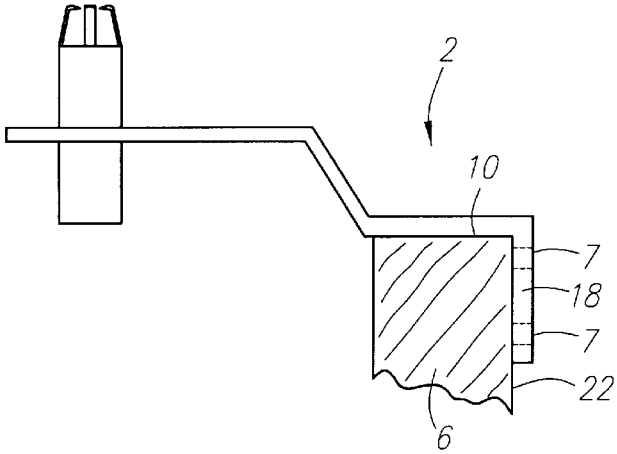
FIG. 5 is a front view of an alternate embodiment of a bolt positioning and retaining device mounted to a vertical surface of a mud wall.
Figure 6:
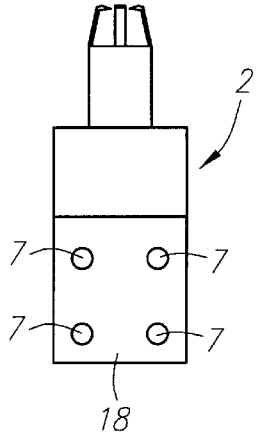
FIG. 6 is a side view of an alternate embodiment of a bolt positioning and retaining device mounted to a vertical surface of a mud wall.

In an alternate embodiment, the apertures 7 extend through the stop 18 rather than through the base 4. FIG. 5 shows a front view of this embodiment, and FIG. 6 shows a side view. By placing the apertures 7 on the stop 18, the bolt positioning and retaining device 2 can be attached to a vertical surface of the mud wall 6, such as the rear surface 22, rather than the upper surface 10.

Figure 7:
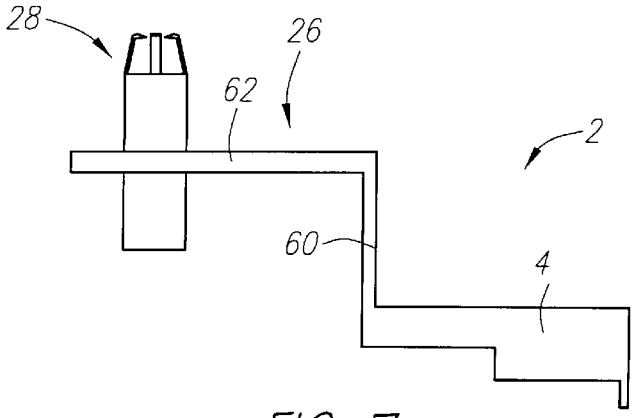
FIG. 7 is a front view of an alternate embodiment of a bolt positioning and retaining device in which an extension arm includes a plurality of subextensions.

In another, separate alternate embodiment, the extension arm 26 forms a shape that includes at least two subextensions. Referring to FIG. 7, a first subextension 60 and a second subextension 62 are seen. The first subextension 60 and the second subextension 62 are preferably formed from a single piece of material to constitute the extension arm 26. However, a separate first subextension 60 and second subextension 62 may optionally be assembled together to form the extension arm 26. In this alternate embodiment, the first subextension 60 extends from the base 4. Preferably, it extends substantially vertically upward from the base 4. The second subextension 62 then extends substantially horizontally outward from the upper end of the first subextension 60. The bolt retainer 28 is attached to the second subextension 62. The effect of the combination of the first subextension 60 and the second subextension 62 is to place the bolt retainer 28 in substantially the same position relative to the base 4 as it would occupy if it were instead located on the extension arm 26 of the preferred embodiment projecting at an angle 27 from the base 4. In this alternate embodiment, the first subextension 60 may extend at any angle relative to the base 4, and the second subextension 62 may extend at any angle relative to the first subextension 60, so long as the bolt retainer 28 is consequently placed in the desired location above the foundation to be poured and away from the front surface 22 of the mud wall 6.

Figure 8:
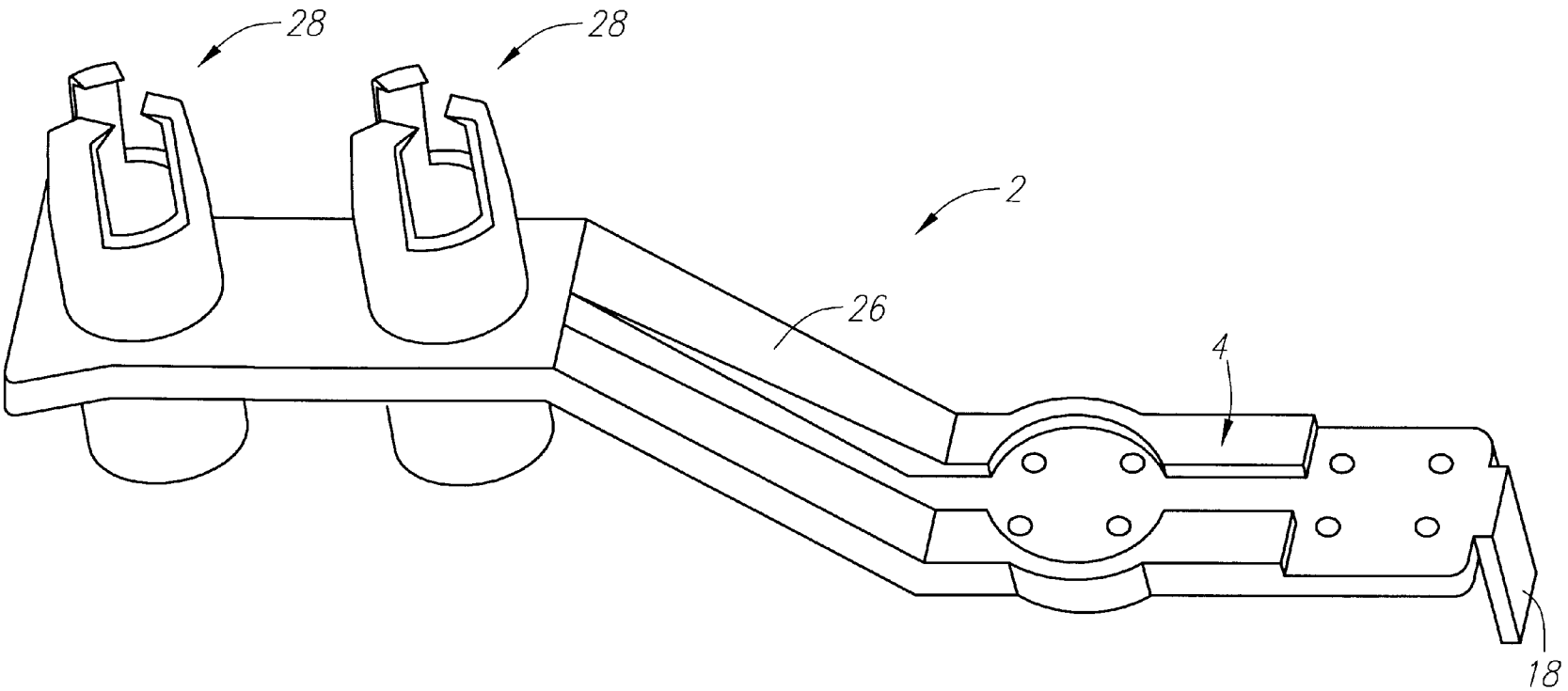
FIG. 8 is a perspective view of an alternate embodiment of a bolt positioning and retaining device that includes a plurality of bolt retainers.

In another, separate alternate embodiment, the extension arm 26 includes a plurality of bolt retainers 28. This embodiment is shown in FIG. 8. In this embodiment, the bolt positioning and retaining device 2 includes a base 4 without steps. Instead, the extension arm 26 includes a plurality of bolt retainers 28 located at known distances relative to the stop 18. Thus, the anchor bolt 34 may be positioned properly to accept sill plates of different sizes by simply selecting the appropriate bolt retainer 28 to accept the anchor bolt.

Figure 9:
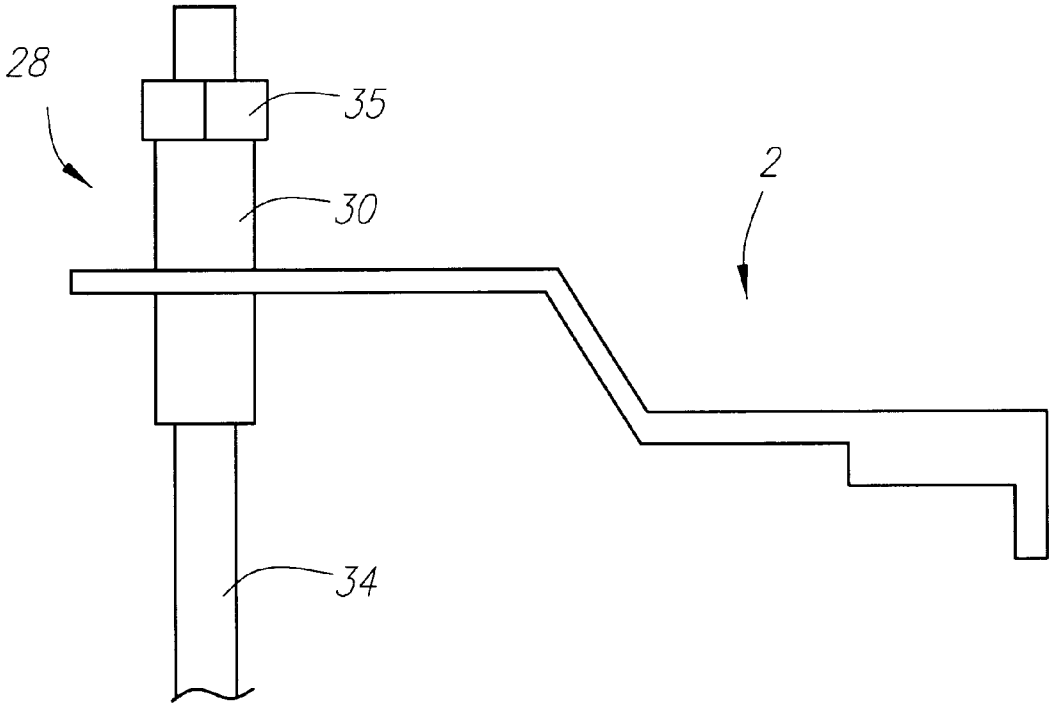
FIG. 9 is a front view of an alternate embodiment of a bolt positioning and retaining device with an alternate bolt retainer.

In another, separate alternate embodiment, the bolt retainer 28 includes the upper tube 30 but does not include thread grippers 32. This embodiment is shown in FIG. 9. In this embodiment, the anchor bolt 34 is held in place by a nut 35. The nut 35 possesses an outer diameter greater than the inner diameter of the upper tube 30. The nut 35 can thus rest atop the upper tube, holding the anchor bolt 34.

In another, separate alternate embodiment, the bolt retainer 28 does not include the upper tube 30, and instead simply comprises one or more thread grippers 32. In another, separate alternate embodiment, the tips 40 are attached directly to the upper tube 30, and the thread grippers 32 and the heads 38 are not included.

In another, separate alternate embodiment, a single step 13 extends below the base 4 and is capable of sliding back and forth relative to the base 4, such that the location of the step face 14 may be varied. By varying the location of the step face 14, the location of the bolt retainer 28 relative to the front surface 16 of the mud wall 6 changes, allowing the bolt retainer 28 to position the anchor bolt 34 properly relative to the edge of the foundation to accept sill plates of varying sizes.

It is contemplated that the features of the alternate embodiments disclosed above may be combined with one another or with the preferred embodiment to form a bolt positioning and retaining device 2.

While the bolt positioning and retaining device 2 has been discussed above relative to building construction, it is not limited to that application. The bolt positioning and retaining device 2 may be utilized in any situation where a bolt is desired to be anchored in concrete or the like. Further, the bolt positioning and retaining device 2 has been discussed in the context of holding an anchor bolt 34. However, the bolt positioning and retaining device 2 may be used to hold other types of bolts in place; it is not limited to use with anchor bolts.

A preferred bolt positioning and retaining device apparatus and many of its attendant advantages have thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

What is claimed is:

1. A bolt positioning and retaining device adapted to hold a threaded bolt, comprising:

a base;

an extension arm, extending outward from and at an angle to said base; and a bolt retainer connected to the extension arm, comprising a hollow upper tube extending upward from said extension arm, said upper tube sized to admit the bolt; and a plurality of flexible thread grippers adapted as a group to hold the bolt, each said thread gripper having a body attached to said upper tube and a head attached to said body, each said head of each said thread gripper adapted to fit into and bias against at least one thread of the bolt.

2. The bolt positioning and retaining device of claim 1, the base having at least one downwardly-extending step.

3. The bolt positioning and retaining device of claim 2, each step having a substantially vertical face.

4. The bolt positioning and retaining device of claim 3, each step face being oriented substantially toward the bolt retainer.

5. The bolt positioning and retaining device of claim 1 further comprising a stop extending substantially downward from said base.

6. The bolt positioning and retaining device of claim 5, the stop being located at the opposite end of the base from the extension arm.

7. The bolt positioning and retaining device of claim 5, the stop defining one or more apertures therethrough.

8. The bolt positioning and retaining device of claim 1, the bolt retainer being located on the extension arm at its opposite end from the base.

9. The bolt positioning and retaining device of claim 1, one end of the extension arm including a bolt retainer flange extending radially outwardly from the bolt retainer.

10. The bolt positioning and retaining device of claim 1, the extension arm further including at least one more bolt retainer.

11. The bolt positioning and retaining device of claim 1 further comprising a hollow open-ended lower tube extending downward from the bolt retainer.

12. The bolt positioning and retaining device of claim 1, the base defining one or more apertures therethrough.

13. A bolt positioning and retaining device adapted to hold a threaded bolt, comprising:

a base;

an extension arm, extending outward from and at an angle to said base;

a stop extending downward from said base;

at least one step extending downward from said base, each said step having a substantially vertical face; and a bolt retainer connected to the extension arm, comprising a hollow upper tube extending upward from the extension arm and a plurality of flexible thread grippers adapted as a group to hold the bolt, each said thread gripper having a body attached to said upper tube and a head attached to said body, each said head of each said thread gripper adapted to fit into at least one thread of and bias against a bolt admitted into the bolt retainer.

14. A bolt positioning and retaining device adapted to hold a threaded bolt, comprising:

a base;

an extension arm connected to said base, comprising a plurality of subextensions connected to one another; and at least one bolt retainer connected to said extension arm, each said bolt retainer comprising a hollow upper tube extending upward from said extension arm; and a plurality of flexible thread grippers adapted as a group to hold the bolt, each said thread gripper having a body attached to said upper tube and a head attached to said body, each said head of each said thread gripper adapted to fit into and bias against at least one thread of the bolt.

15. The bolt positioning and retaining device of claim 1, wherein said bolt positioning and retaining device has three thread grippers.

16. The bolt positioning and retaining device of claim 1, wherein said thread grippers extend upward from said upper tube and inward substantially toward the axial centerline of said upper tube.

* * * * *

UNITED STATES PATENT AND TRADEMARK OFFICE

CERTIFICATE OF CORRECTION

PATENT NO. : 6,065,730
DATED : May 23, 2000
INVENTOR(S) : Robin Marks and Gregory S. Powell It is certified that error appears in the above-indentified patent and that said Letters Patent is hereby corrected as shown below:

In claim 1, column 9, line 33, "sized" should read --adapted--.

Signed and Sealed this

Third Day of April, 2001

*Attest:*

Nicholas P. Godici

NICHOLAS P. GODICI

*Attesting Officer*

*Acting Director of the United States Patent and Trademark Office*